US008715017B1

(12) United States Patent
Barber et al.

(10) Patent No.: US 8,715,017 B1
(45) Date of Patent: May 6, 2014

(54) TERMINAL BLOCK HAVING AN EXTENDER BODY FITTED TO A CONTACT BODY

(71) Applicant: Phoenix Contact Development & Manufacturing, Inc., Middletown, PA (US)

(72) Inventors: Terry Lee Barber, Harrisburg, PA (US); Michael Anthony Correll, Hershey, PA (US); Michael Brauns, Emmerthal (DE)

(73) Assignee: Phoenix Contact Development and Manufacturing, Inc., Middletown, PA (US)

( * ) Notice: Subject to any disclaimer, the term of this patent is extended or adjusted under 35 U.S.C. 154(b) by 45 days.

(21) Appl. No.: 13/647,440

(22) Filed: Oct. 9, 2012

Related U.S. Application Data

(60) Provisional application No. 61/596,374, filed on Feb. 8, 2012.

(51) Int. Cl.
*H01R 9/26* (2006.01)

(52) U.S. Cl.
USPC ..... 439/716

(58) Field of Classification Search
CPC ..... H01R 9/24; H01R 9/2491; H01R 9/2675; H01R 9/26; H01R 9/2608; H01R 9/2408
See application file for complete search history.

(56) References Cited

U.S. PATENT DOCUMENTS

| | | | | |
|---|---|---|---|---|
| 3,288,301 | A | 11/1966 | Kent et al, | |
| 4,407,416 | A | 10/1983 | Anderson | |
| 5,014,163 | A | 5/1991 | Lin | |
| 5,383,793 | A | 1/1995 | Hsu et al. | |
| 5,615,079 | A * | 3/1997 | Eggert et al. | 361/637 |
| 5,629,831 | A * | 5/1997 | Eggert et al. | 361/624 |
| 5,651,702 | A * | 7/1997 | Hanning et al. | 439/715 |
| 6,392,319 | B1 * | 5/2002 | Zebermann et al. | 307/147 |
| 6,575,771 | B2 * | 6/2003 | Schnatwinkel et al. | 439/76.1 |
| 6,626,709 | B2 | 9/2003 | Cisey | |
| 6,663,441 | B1 | 12/2003 | Alexandre et al. | |
| 6,752,276 | B2 | 6/2004 | Rumney | |
| 7,140,900 | B1 | 11/2006 | Villanueva | |
| 7,462,063 | B1 * | 12/2008 | Correll | 439/460 |
| 7,491,096 | B1 * | 2/2009 | Correll | 439/716 |
| 7,553,199 | B2 * | 6/2009 | Correll | 439/715 |
| 7,559,807 | B2 | 7/2009 | Freimuth et al. | |

FOREIGN PATENT DOCUMENTS

| | | | |
|---|---|---|---|
| DE | 19744827 | A1 | 4/1999 |
| DE | 10005818 | A1 | 8/2001 |
| DE | 202004013226 | U1 | 12/2004 |
| EP | 1052734 81 | | 11/2000 |
| EP | 2020718 | A1 | 2/2009 |
| WO | 0159898 | A1 | 8/2001 |
| WO | 2010066549 | A1 | 6/2010 |

* cited by examiner

*Primary Examiner* — Chandrika Prasad
(74) *Attorney, Agent, or Firm* — Hooker & Habib, P.C.

(57) ABSTRACT

A terminal block for mounting on a DIN rail includes a plurality of stacked modules with each module having a contact body and an extender body mounted on the contact body. A circuit board or electronic component is mounted on the contact body and the extender body. Different size extender bodies may be mounted on a common contact body to accommodate mounting different size circuit boards or components on the block.

23 Claims, 7 Drawing Sheets

TERMINAL BLOCK HAVING AN EXTENDER BODY FITTED TO A CONTACT BODY

FIELD OF THE DISCLOSURE

The disclosure relates to a modular terminal block mounted on a DIN rail for connecting wires mounted on the block and an electronic component, which may be a circuit board, mounted on the block.

BACKGROUND OF THE DISCLOSURE

DIN rail-mounted terminal blocks for forming electrical connections between wires and circuit boards mounted on the block are known. The blocks are typically constructed from a number of like, stacked modules which are secured together by snap-fasteners. The blocks are mounted on DIN rails.

Each module in the block includes wire contacts for forming connections with a number of wires and leads extending from the wire contacts to ends for forming electrical connections with a circuit board mounted on a recess in the block. The recess is sized to fit the component. Blocks accommodate one size circuit board only. Different size modules are required to accommodate different size circuit boards.

The manufacture of different size modules in order to accommodate different size circuit boards is expensive. Separate tooling is required to make different size modules. Separate inventories of different size modules are required.

Accordingly, there is a need for an improved DIN rail mounted terminal block to reduce the cost of manufacture and reduce inventories.

SUMMARY OF THE DISCLOSURE

The disclosure is an improved modular terminal block for mounting on a DIN rail with stacked modules where each module includes a contact body and an extender body mounted on the contact body. The contact body and extender body define a recess for receiving an electronic component which may be a circuit board. The contact bodies contain connectors for receiving wires and leads extending from the connectors to contacts for the circuit board or component mounted in the recess.

Different size extender bodies are mounted on standard contact bodies in order to provide different size recesses for different size electronic components. The use of different size extender bodies reduces manufacturing and inventory cost for modular DIN rail terminal blocks used with different size circuit boards or electronic components.

DESCRIPTION OF THE PREFERRED EMBODIMENTS

Figure 1:
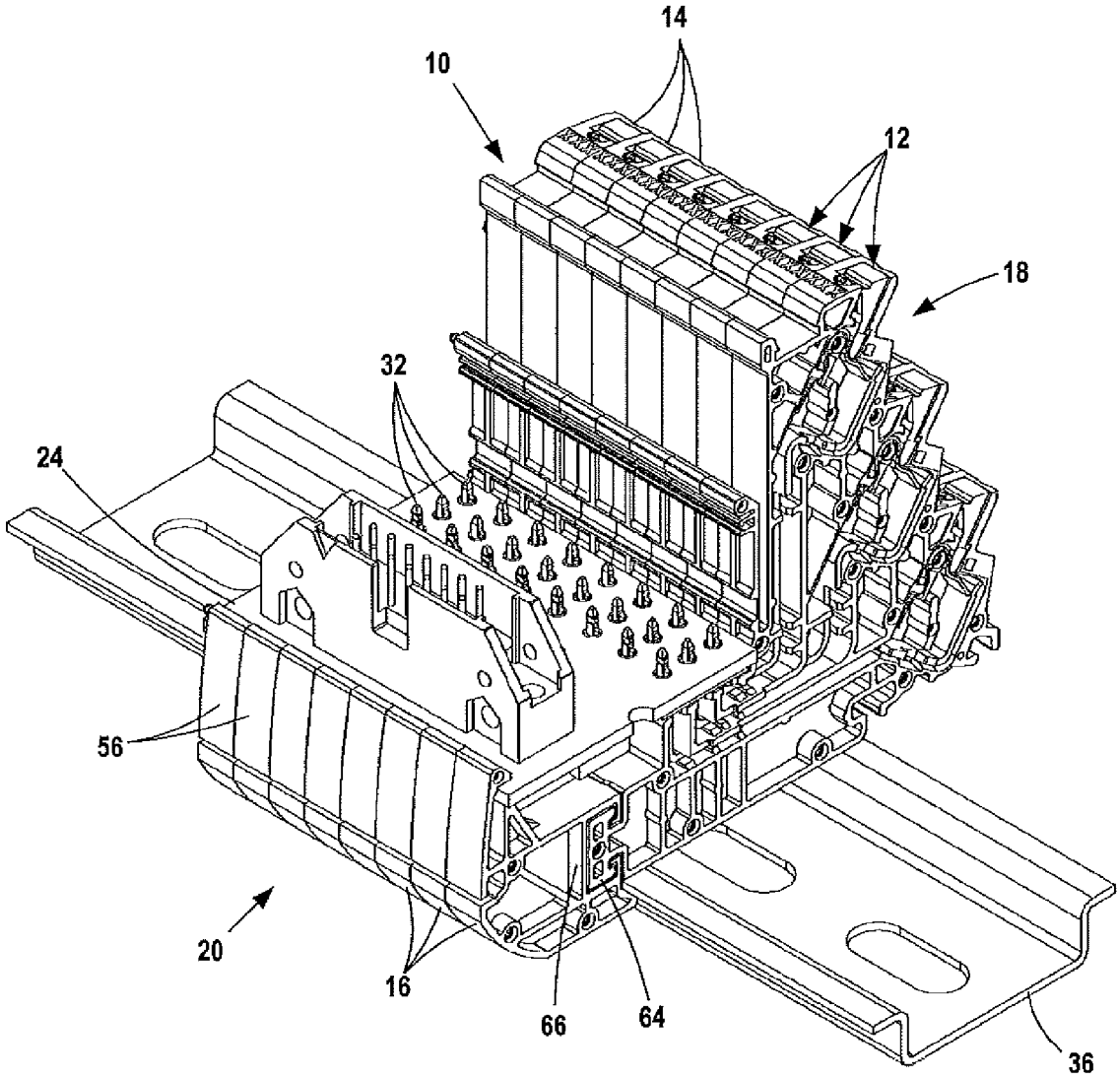
FIG. 1 is a perspective view of a first embodiment modular terminal block mounted on a DIN rail.
Figure 2:
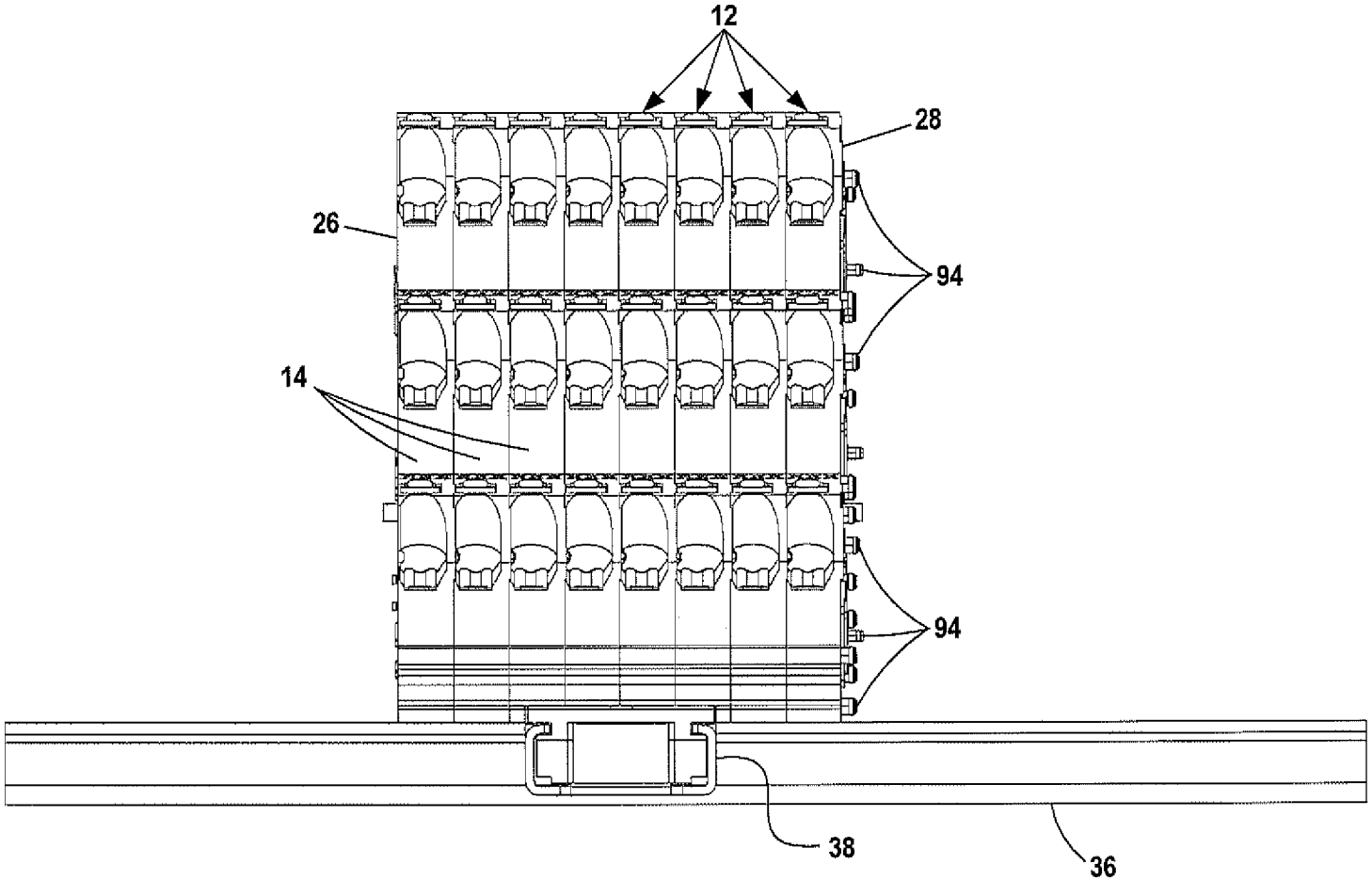
FIG. 2 is a side view of the terminal block and rail illustrated in FIG. 1.
Figure 3:
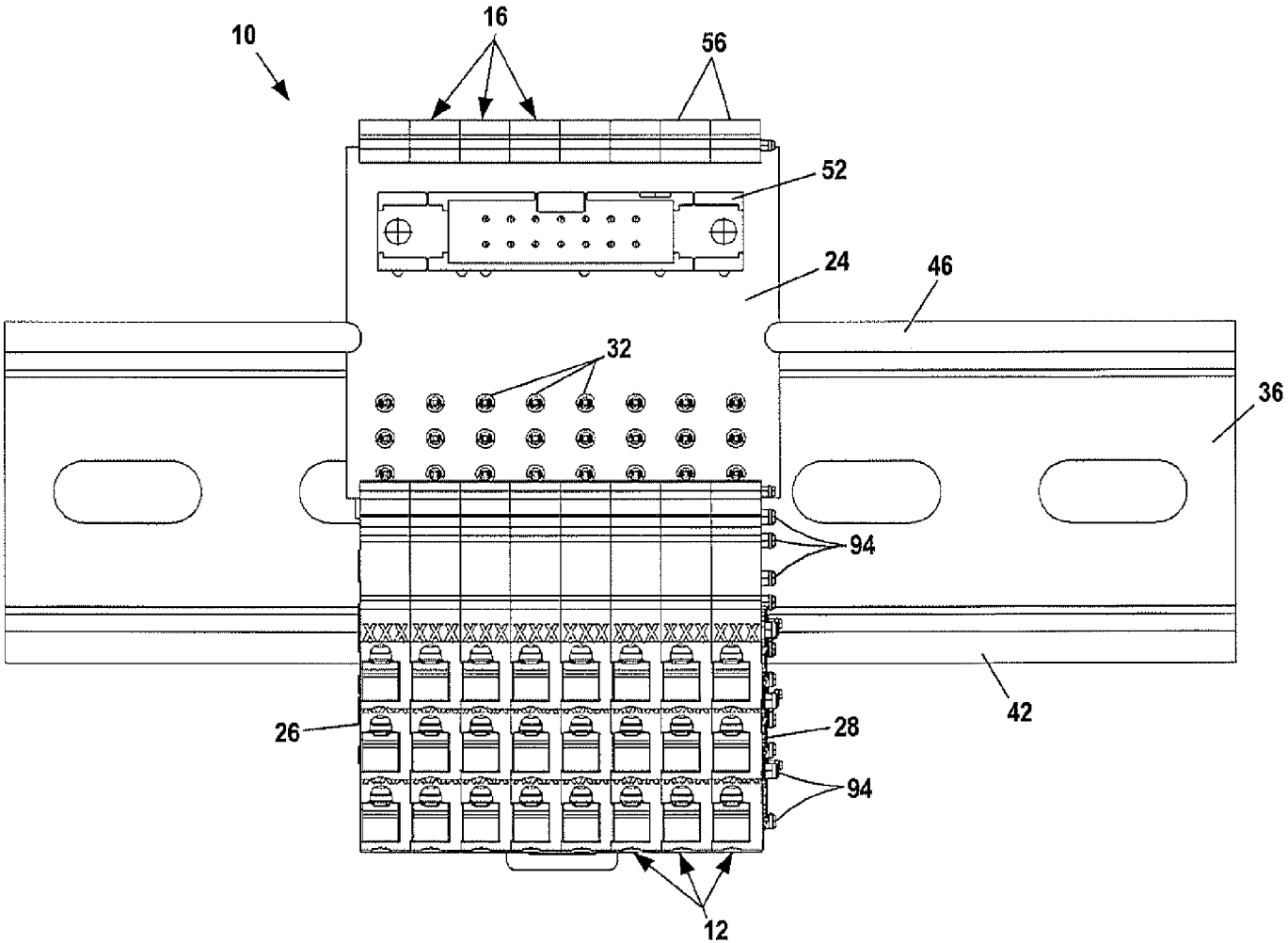
FIG. 3 is a top view of FIG. 1.

The disclosed modular terminal blocks are related to the blocks disclosed in U.S. Pat. No. 7,491,096, the disclosure of which is incorporated herein by reference, in its entirety.

First embodiment modular terminal block 10, shown in FIGS. 1-7, includes a plurality of identical flat and uniform thickness slices or modules 12. The slices or modules are stacked together to form the block. End plates (not illustrated) are snapped on the ends of the block.

Each slice or module 12 has opposed and parallel sides 26 and 28 and a thickness 13. See FIG. 6. Each slice or module 12 also includes a molded plastic contact body 14 and a molded plastic extender body 16. Contact bodies 14 are located on input/output side or edge 18 of the block 10. Extender bodies are located on circuit board side or edge 20, across the slices from the input/output side 18. The bodies 14 and 16 in each module are joined together by press-fit engagements 29. The assembled slices form a circuit board or electronic component recess or space 22 located between sides 18 and 20 and having a width 25. The length 33 of contact bodies 14 and the length 35 of extender bodies 16 extend across and determine the width 25 of recess 22 and the width of circuit board 24 or a component mounted in recess 22. Different length extender bodies 16 may be mounted on contact bodies 14 to provide a recess 22 for support of a given width board or component.

Slices 12 have opposed, parallel sides 26 and 28. Three formed metal leads 30 are fitted in grooves 31 on side 26 of each contact body 14 and extend from pin contacts 32 in recesses 22 to wire contacts 34 at block side 20. The leads establish electrical connections between wires inserted into contacts 34 in contact body 14 and circuitry on circuit board 24 mounted in recess 22.

Figure 4:
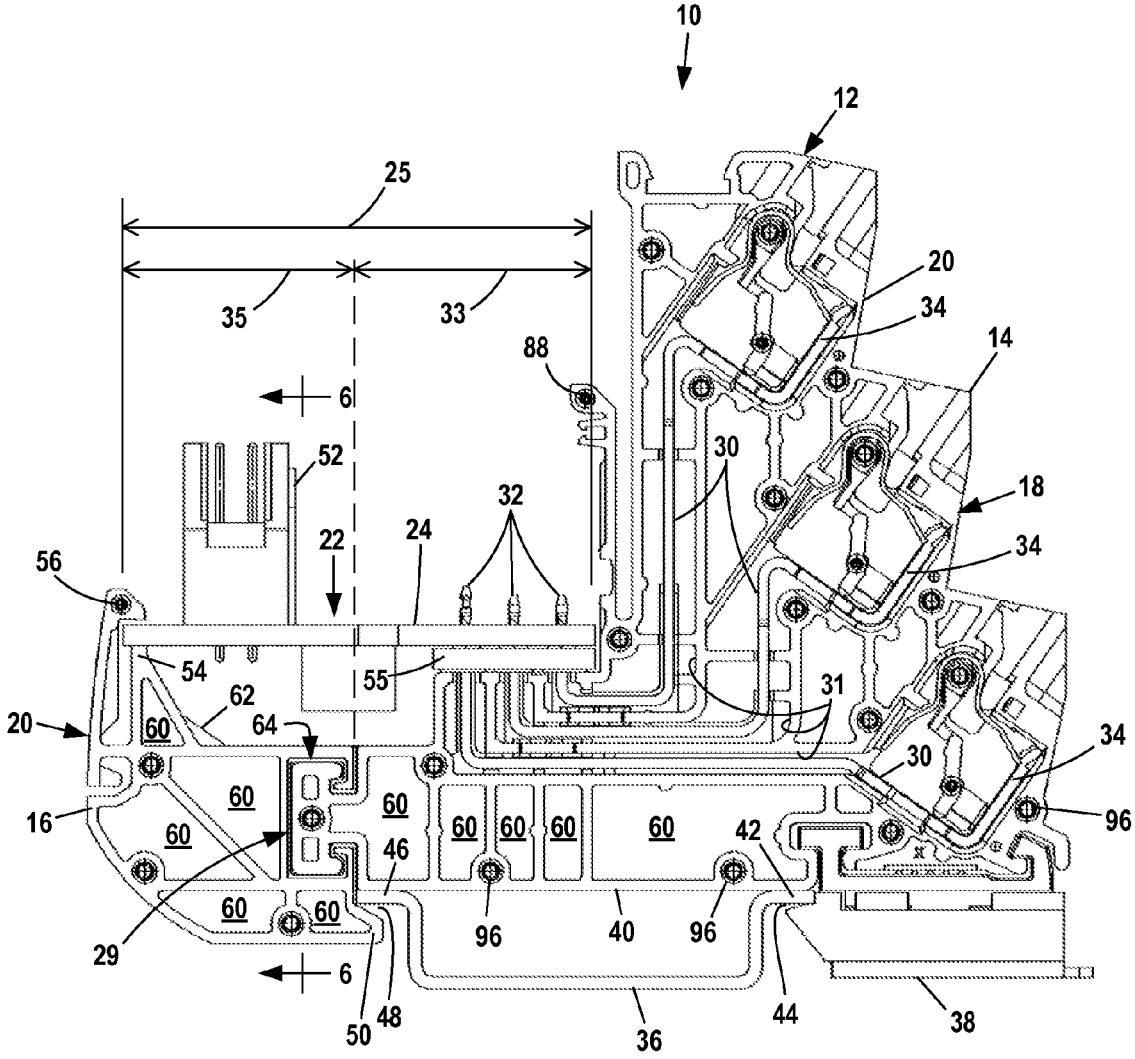
FIG. 4 is an end view of the terminal block and rail.

Terminal block 10 is mounted on DIN rail 36. DIN rail latch 38 is mounted on bottom surfaces 40 of the contact bodies 14 as shown in FIG. 4. DIN rail flange 42 extends into recess formed between latch 38 and bottom surfaces 40 of contact bodies 14. The other DIN rail flange 46 extends into recess 48 formed between contact body bottom surfaces 40 and projections or noses 50 on the bottom portions of extender bodies 16. The latch 38 and projections 50 underlie bottom surfaces 40. Projection 50 is located between latch 38 and interfit connection 29. See FIG. 4.

Circuit board 24 is fitted in recess 22 with pin contacts extending through holes in the circuit board 24 to form electrical connections with components mounted on the board, including input/output connector socket 52. The outer edge of the circuit board is supported by posts 54. The inner edge of circuit board 24 is supported by alignment plate 55 which in turn is supported by contact bodies 14. The circuit board is held in place in the recess 22 by flexible latches 56 located on extender bodies 16 outside posts 54.

The contact body 14 and extender body 16 are molded from thermoplastic material and each includes a number of walls 58 extending across the thickness of the body from side 26 to side 28. Transverse interior walls 60 are parallel to sides 26 and extend across the openings 61 defined by walls 60. Openings 61 in the contact body 14 are below the portion of contact body 14 carrying leads 30. Walls 58 and 60 strengthen the bodies. Gussets 62 strengthen posts 54.

A T-shaped head or mounting member 64 is provided on each contact body 14 adjacent an extender body 16. Each extender body 16 has a T-shaped recess or mounting opening 66 for receiving mounting member 64 and securing the extender body on the contact body. Mounting member 64 has a narrow neck 68 and a wide head 70 on the outer end of neck 68. Head 70 extends laterally to either side of neck 68 and includes two end ribs 72 located to either side of neck 68. The ribs extend a distance toward the remainder of contact body 14. The outer walls at the end of contact body 14, neck 68, head 70 and ribs 72 define two L-shaped locking recesses 74 on opposite sides of neck 68. Recesses 74 extend across the thickness of body 14.

The mounting opening 66 in each extender body 16 includes a rectangular recess 76 extending from side 26 to side 28 and a central slot 78 formed in the inner end of the extender body and leading to recess 76. Inner ends of the walls of slot 78 extend into the recess 76 to form L-shaped arms 80 which fit tightly in recesses 74 when extender body 16 is mounted on contact body 14 and head 70 is moved into mounting opening 66.

Figure 7:
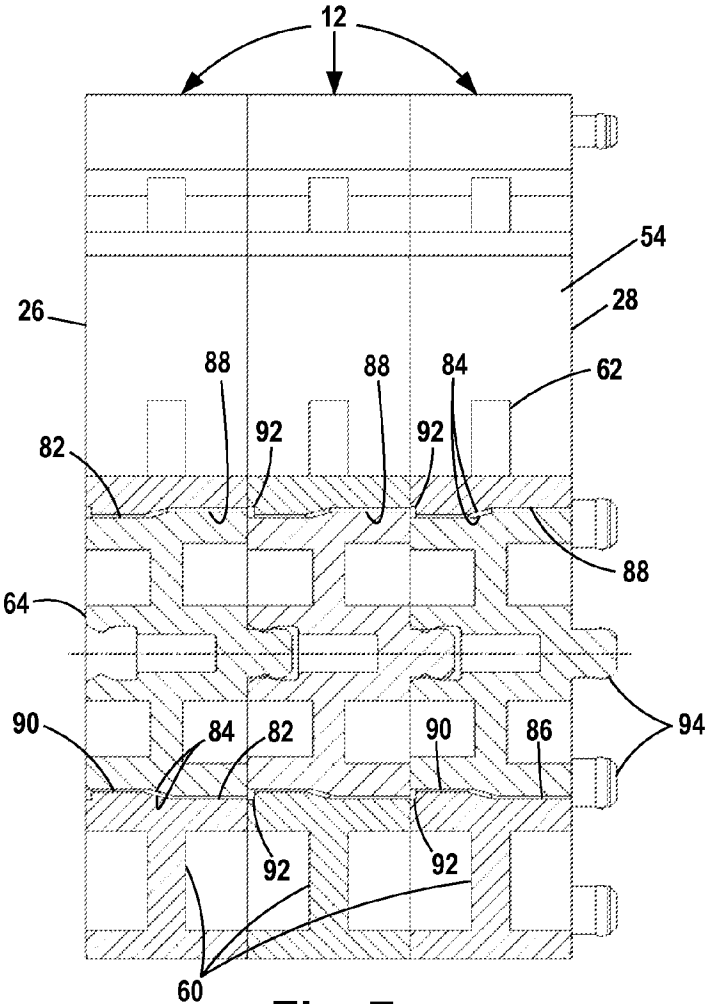
FIG. 7 is a sectional view like FIG. 6 taken across three joined slices.
Figure 6:
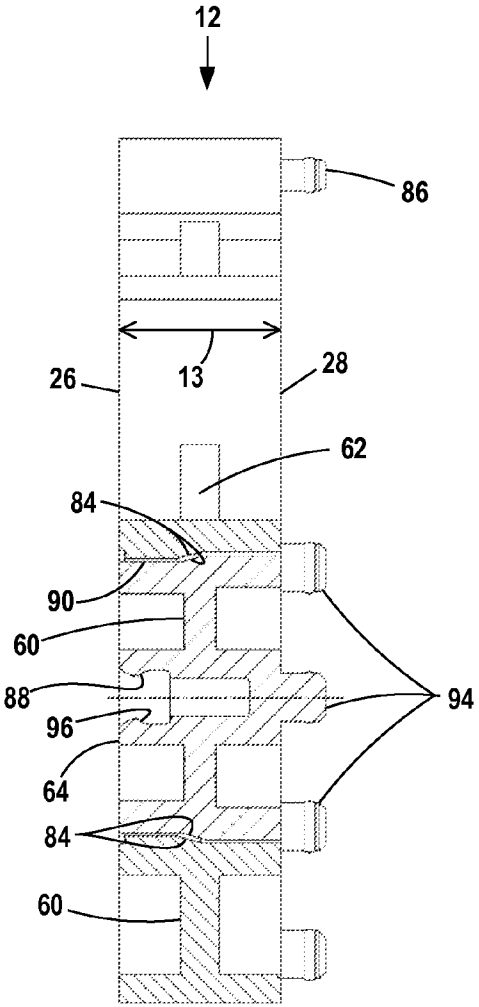
FIG. 6 is a sectional view taken across one slice along line 6-6 of FIG. 4 with the circuit board removed.

Beveled surfaces 84 extend around mounting members 64 and openings 66, and are located centrally between sides 26 and 28. Surfaces 84 overly each other. Undercut or recessed circumferential wall 82 extends around the mounting member 64 from the beveled surface 84 to side 26. Raised circumferential wall 86 extends around the mounting member from the beveled surface to side 28. As illustrated in FIGS. 6 and 7, the undercut wall 82 makes the mounting member 64 smaller at side 26 than at side 28.

Beveled surfaces 84 extend around the walls forming mounting openings 66. Undercut or recessed circumferential wall 88 extends around mounting opening 66 from the beveled surface to side 28. Raised circumferential wall 90 extends around the recess and extends from the beveled surface 88 to side 26. As illustrated in FIG. 6, the mounting opening 66 is smaller at side 26 than at side 28.

Figure 5:
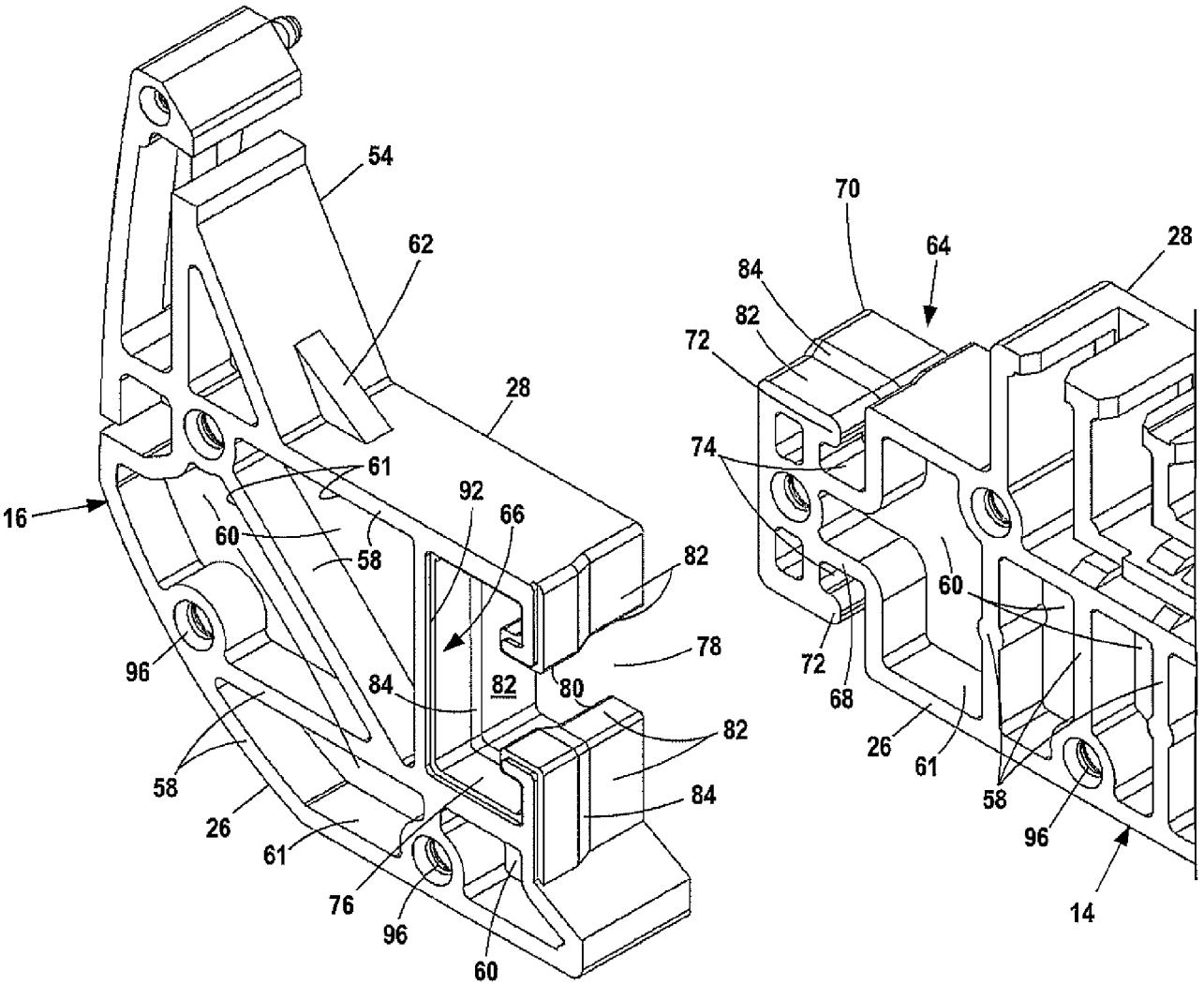
FIG. 5 is a perspective view illustrating mounting an extender body on a contact body to form a slice.

The beveled surfaces, undercut walls and raised walls facilitate moving the mounting member 64 into mounting opening 66. As illustrated in FIG. 5, extender body 16 is positioned outwardly from side 26 of the contact body 14 with the mounting member 64 and mounting opening 66 in alignment. The extender body is then moved toward the contact body to position the smaller end of the mounting member 64 into the enlarged side of mounting opening 66. Further movement of the extender body toward the contact body positions the two bodies together as shown in FIG. 6 with adjacent undercut and raised surfaces fitted together, beveled surfaces 84 adjacent each other and sides 26 and 28 aligned. Each extender body 16 is mounted on a contact body 14 by a press-fit connection 29 between the bodies.

Dimensional tolerances inherent in molding of plastic parts may result in the thickness of the mounting member 64 being slightly greater than the thickness of the surrounding walls of recess 76. A small circumferential groove 92 is formed in the edge of each mounting wall 90 of opening 66 to accommodate slightly thick mounting members 64. See FIGS. 5 and 7.

A plurality of slices 12, shown in FIG. 6, are assembled together to form block 10. Individual slices are held together by extending snap pins 94 extending outwardly from side 28 of the slice into pin recesses 96 on side 26 of an adjacent slice. Assembly of block 10 is completed by mounting DIN rail latch 38 on the body-side of the block and mounting end plates on the ends of the body, using snap pins and snap recesses.

Projections 50 on the extender bodies 16 form a continuous profile along the bottom of block 10 opposite from DIN rail latch 38. The block 10 is mounted on DIN rail 36 by retracting the latch 38, positioning flange 46 in recess 48, pivoting the block down to rest flush on rail 36 and then releasing latch 38. Flange 46 is held in recess 48 between the bottom surface 40 of the bodies and projections 50 on the extenders. Projections 50 and latch 38 are below bottom surface 40 of contact bodies 14. The projections 50 are between the mounting members 64 and opening 66 and latch 38.

Figure 8:
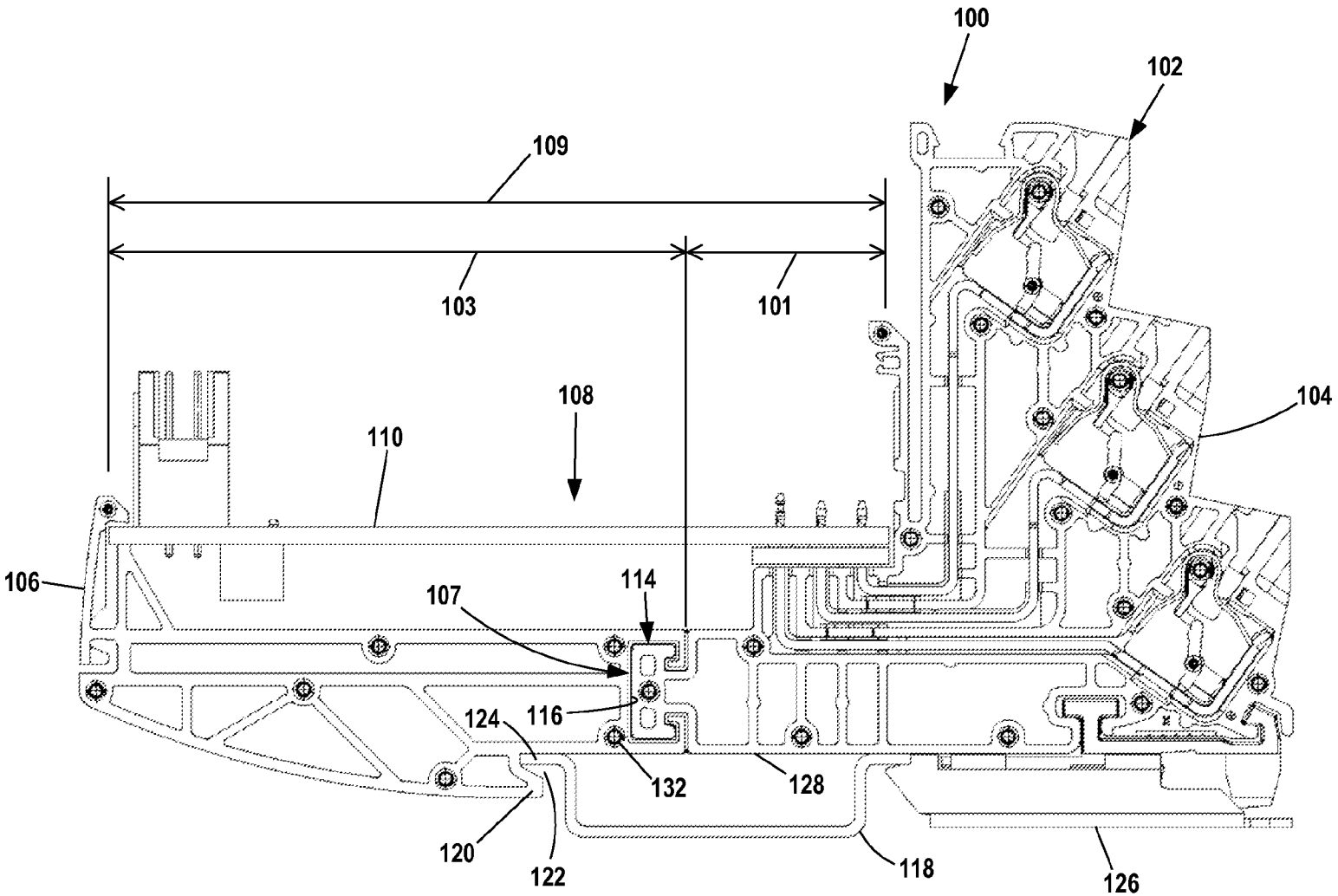
FIG. 8 is a view like FIG. 4 illustrating a second embodiment modular terminal block.

FIG. 8 illustrates a second embodiment modular terminal block 100 with a plurality of modules or slices 102. Each slice has a contact body 104 and an extender body 106. Bodies 104 are like bodies 14. Extender bodies 106 have a greater length away from the bodies 104 than extender bodies 16 to form an enlarged recess 108 to accommodate wide circuit board 110. Each extender body 106 is mounted on a body 104 by press-fit engagement 107 between a T-shaped mounting member 114 on body 104 and a T-shaped opening 116 on the extender body. Mounting member 114 is like mounting member 64. Opening 116 is like mounting opening 66. The extender bodies are mounted on contact bodies 104 the same way as illustrated in FIG. 5. Block 100 is mounted on DIN rail 118.

The width 109 between the opposed sides of recess 108 is greater than the width 25 between the opposed sides of recess 22 in module 12. Contact body 104 is identical to body 14 and has a length 101 in recess 108 equal to the length 33 of body 14 in recess 22. Extender body 106 is longer than body 16 and has a length 103 in recess 108 greater than length 35 of body 16 in recess 22. Wide circuit board 110 is mounted in recess 108.

In order to properly balance block 100 on DIN rail 118, the center line of rail 118 should be as close as possible to the center line of the block. This is done by locating the projection 120 forming recess 122 for DIN rail flange 124 away from bodies 104 and moving the DIN rail latch 126 correspondingly outwardly or to the left in FIG. 8. This balances the block on the DIN rail. The relative outer location of the DIN rail shifts recess 122 away from body bottom surface 128 so that the extender nose or projection 120 and extender bottom surface 132 form the sides of recess 122, and the DIN rail flange 124 does not engage bottom surface 128 of body 104. The member 114 and opening 116 are between projections 120 and latch 126.

Both modular terminal blocks 10 and 102 are made up of a number of slices or modules mounted together, with each slice or module including a contact body and an attached extender body for supporting a circuit board. A number of strip conductors are mounted in the contact body to provide electrical connections between wires inserted in the body and a circuit board mounted on the block. The disclosure permits use of a standard contact body with appropriate DIN rail latches and different size extender bodies to accommodate different size circuit boards. The disclosure obviates the need to provide and maintain a large number of molds for making individual sized single-piece slices.

The components may be mounted on a suitable connector on block 10 or 100. Electronic components may include controls, switches, resistance networks, calculators and other electronic devices. The components may be housed in a container mounted on one of the blocks.

What we claim as our invention is:

1. A modular DIN rail terminal block forming electrical connections between a number of wires and a circuit board mounted on the block, the block comprising:

A. a plurality of modules, each module including:

i) a contact body with opposed sides and opposed edges, ii) a plurality of wire contacts on one edge of the contact body, a plurality of pin contacts on the opposite edge of the contact body, leads in the contact body extending between the wire contacts and the pin contacts, and a first circuit board support on the opposite edge of the contact body, iii) an extender body with opposed sides and opposed edges, iv) a second circuit board support on the extender body, and v) a press-fit connection in the module, the connection attaching the extender body to the contact body below the circuit board supports, the press-fit connection including a head on one body fitted in an opening in the other body, vi) said modules stacked together side-by-side to form the terminal block; and B. a DIN rail latch on the bottom of the terminal block for engaging one flange of a DIN rail supporting the terminal block, and a DIN rail projection on the bottom of the terminal block facing the DIN rail latch for engaging another flange of a DIN rail supporting the terminal block;

C. wherein each contact body has a fixed length across the module and each extender body has a selected length across the module dependent upon the width of a circuit board on the board supports.

2. A modular terminal block as in claim 1 wherein in each module, the head and the opening extend across the entire thickness of the module, the head includes a larger portion at a first side of the module and a smaller portion at a second side of the module, and the opening includes a larger portion at the first side of the module and a smaller portion at a second side of the module.

3. A modular terminal block as in claim 2 wherein in each module, a beveled surface extends around the head between the module sides.

4. A modular terminal block as in claim 2 wherein in each module a first beveled surface extends around the recess between the modules sides, and a second beveled surface extends around the head and overlaps the first beveled surface.

5. A modular terminal block as in claim 2 wherein in each module a groove extends around the smaller portion of the recess at the second side of the module.

6. A modular terminal block as in claim 5 wherein in each module, the recess and head are T-shaped.

7. A modular terminal block as in claim 6 wherein in each module the head includes a pair of ribs extending across the thickness of the module and each recess includes a wall surrounding each rib.

8. A modular terminal block as in claim 1 wherein in one module the connection is located between a DIN rail latch and a DIN rail projection.

9. A modular terminal block as in claim 1 wherein in one module a DIN rail projection is located between a DIN rail latch and a connection.

10. A modular DIN rail terminal block forming electrical connections between a number of wires and an electronic component mounted on the block, the block comprising:

A. a plurality of modules, each module having opposed parallel sides, and including:

i) a contact body with opposed edges, ii) an extender body, iii) a plurality of first contacts on one edge of the contact body, a plurality of second contacts on an opposite edge of the contact body, conductors in the contact body extending between the first contacts and the second contacts, and a first electronic component support on the opposite edge of the contact body, iv) a second electronic component support on the extender body, and v) a connection securing the extender body to the contact body below the supports, the connection including a convex member on one body fitted in a concavity in the other body, said convex member and said concavity each located between the sides of the module, vi) said modules stacked together side-by-side to form the terminal block; and B. a DIN rail latch on the bottom of one contact body for engaging one flange of a DIN rail supporting the terminal block, and a DIN rail projection on the bottom of one extender body for engaging another flange of the DIN rail supporting the terminal block;

C. wherein the contact bodies have a fixed dimension across the terminal block and the extender bodies have a selected dimensional across the terminal block dependent upon the width of an electronic component on the module supports.

11. A modular terminal block as in claim 10 wherein in each module, the convex member and the concavity extend across the entire thickness of the module, the convex member includes a larger portion at a first side of the module and a smaller portion at a second side of the module, and the concavity includes a larger portion at the first side of the module and a smaller portion at a second side of the module.

12. A modular terminal block as in claim 11 wherein in each module a first beveled surface extends around the convex member, a second beveled surface extends around the concavity and the beveled surfaces overlap each other.

13. A modular terminal block as in claim 12 wherein in each module a groove extends around the concavity at a side of the module.

14. A modular terminal block as in claim 11 wherein in each module, the convex member and the concavity are T-shaped.

15. A modular terminal block as in claim 10 wherein in each module the convex member includes a pair of ribs extending across the module and each concavity surrounds a rib.

16. A modular terminal block as in claim 10 wherein in each module the connection is located between the DIN rail latch and the DIN rail projection.

17. A modular terminal block as in claim 10 wherein the DIN rail projection is located between the DIN rail latch and the connection.

18. A modular DIN rail terminal block forming electrical connections between a number of wires and an electronic component mounted on the block, the terminal block comprising:

A. a plurality of modules having opposed parallel sides, each module including:

i) a contact body, ii a first electronic component support on the contact body, iii) an extender body, iv) a second electronic component support on the extender body, and v) a press-fit connection securing the extender body to the contact body below the supports, the press-fit connection including a convex member on one body fitted in a concavity in the other body, said convex member and said concavity each located between the sides of the module and below the first and second supports, vi) said modules stacked together side-by-side to form the terminal block; and B. a first DIN rail mounting member on the bottom of one contact body for engaging one flange of a DIN rail supporting the terminal block, and a second DIN rail mounting member on the bottom of one extender body for engaging another flange of the DIN rail supporting the terminal block;

C. wherein the contact bodies have a fixed dimension along the modules and the extender bodies have a selected dimension along the modules dependent upon the dimension along the modules of an electronic component on the supports.

19. A modular terminal block as in claim 18 wherein in each module the press-fit connection is located between the DIN rail latch and the DIN rail projection.

20. A modular terminal block as in claim 18 wherein in each module the DIN rail projection is located between the DIN rail latch and the press-fit connection.

21. A modular terminal block forming electrical connections between a number of wires and an electronic component mounted on the block, the terminal block comprising:

A. a plurality of modules having opposed parallel sides, each module including:

i) a contact body, ii) a first electronic component support on the contact body, iii) an extender body, iv) a second electronic component support on the extender body, and v) a press-fit connection securing the extender body to the contact body below the supports, the press-fit connection including a convex member on one body fitted in a concavity in the other body, said convex member and said concavity each located between the sides of the module and below the first and second supports, vi) said modules stacked together side-by-side to form the terminal block; and B. a mounting device on the bottom of one module engaging a support for the terminal block;

C. wherein the contact bodies have a fixed dimension across the modules, and the extender bodies have a selected dimension across the modules dependent upon the dimension along the modules of an electronic component on the supports.

22. A modular terminal block as in claim 21 wherein said mounting device comprises a DIN rail hook and a DIN rail latch.

23. A modular terminal block as in claim 21 wherein said mounting device comprises structure engaging a DIN rail.

* * * * *